United States Patent [19]

Yoo

[11] Patent Number: 4,719,326

[45] Date of Patent: Jan. 12, 1988

[54] MICROPROCESSOR POWER RELAY CONTROL CIRCUIT FOR A MICROWAVE OVEN

[75] Inventor: Wook Y. Yoo, Seoul, Rep. of Korea

[73] Assignee: Samsung Electronics Co., Ltd., Suwon, Rep. of Korea

[21] Appl. No.: 888,371

[22] Filed: Jul. 23, 1986

[30] Foreign Application Priority Data

Jul. 25, 1985 [KR] Rep. of Korea ..... 1985-9473

[51] Int. Cl.[4] ..... H05B 6/68

[52] U.S. Cl. ..... 219/10.55 B; 219/501; 219/506

[58] Field of Search ..... 219/10.55 B, 10.55 M, 219/489, 490, 492, 501, 506

[56] References Cited

U.S. PATENT DOCUMENTS 4,356,370 10/1982 Horinouchi ..... 219/10.55 B
4,394,557 7/1983 Tachihara et al. ..... 219/10.55 B
4,467,164 8/1984 Nakata et al. ..... 219/10.55 M
4,633,067 12/1986 Payne et al. ..... 219/483

*Primary Examiner*—A. D. Pellinen
*Assistant Examiner*—Leon K. Fuller
*Attorney, Agent, or Firm*—Oblon, Fisher, Spivak, McClelland & Maier

[57] ABSTRACT

A power relay control circuit for a microwave oven including a microprocessor as its controller is provided, wherein two power relay driving transistors are to be turned on or turned off by a thyristor, which is triggered by a switching transistor, and a stabilizing circuit respectively. Two signals of different levels from terminals of the microprocessor are supplied to the base of the switching transistor and the stabilizing circuit in order to make the oven start heating operation. If the microprocessor operates in all possible abnormal states, both signals from the terminals of the microprocessor are to become the same level, all HIGH or all LOW, making either of the power relay driving transistors turned off, resulting in preventing power supply from being applied to the power relay.

2 Claims, 2 Drawing Figures

MICROPROCESSOR POWER RELAY CONTROL CIRCUIT FOR A MICROWAVE OVEN

FIELD OF THE INVENTION

The present invention relates to a power relay control circuit for a microwave oven which employs a microprocessor as its controller, more particularly to a power relay control circuit which can cut out power supply to the power relay in all possible abnormal states of microwave oven by using signals received from the microprocessor.

BACKGROUND OF THE INVENTION

Microwave ovens generate heat in and warm up food or drink by applying microwaves to it for a predetermined period of time. That is accomplished mainly by high-frequency oscillation circuit, i.e. magnetron oscillator with its output of several hundred watts. It is known that food is heated from the outside of it by the conventional cooking appliances. On the contrary, it is heated from the inside and in a very short time when the microwave oven is used.

In such microwave ovens, it is usual that a microprocessor controls high-frequency oscillation of the ovens. In such a controlling process, the microprocessor is apt to keep the magnetron oscillator operating over a predetermined time or to make it operate irrespective of the user's intention, when it is out of order or under the influence of foreign noise(s). Such an abnormal operation of the magnetron can make food burnt and even set a fire.

It is clear that a microwave oven needs to be provided with a safeguard means which can ensure the microwave oven to operate in the exact way as the user wants and prevent an abnormal operation of it.

SUMMARY OF THE INVENTION

It is the object of this invention to provide a microwave oven with a safegard means which can prevent the oven from being operated over a predetermined time or irrespective of the user's intention.

In accordance with the object of the present invention, there is provided a circuit which can prevent the power supply to the magnetron, when the oven is out of order or under the influence of foreign noises.

The power relay control circuit of this invention comprises a microprocessor for use in controlling the microwave oven's heating operation. Two driving transistors are connected in series to a power relay for allowing an electric current flow through the same. A thyristor is connected between one of the driving transistors and two terminals of the microprocessor through its gate-to-cathode path, an oven starting switch and also through its anode-to -cathode path and a switching transistor. A stabilizing circuit is connected between another terminal of the microprocessor and the other of the driving transistors. The stabilizing circuit includes two transistors which operate reversely to each other, that is, one is turned off when the other is turned on and vise versa, and two reverse-biased diodes.

Since the switching means and the stabilizing circuit are provided, the power relay operates to make a route for supplying power source to the magnetron, only when two exact signals as well as the starting signal come out from different output terminals of the microprocessor used as the controller of the oven.

BRIEF DESCRIPTION OF THE DRAWINGS

The present invention will be described in detail with reference to the accompanying drawings, in which.

DETAILED DESCRIPTION OF THE PREFERRED EMBODIMENT

Figure 1:
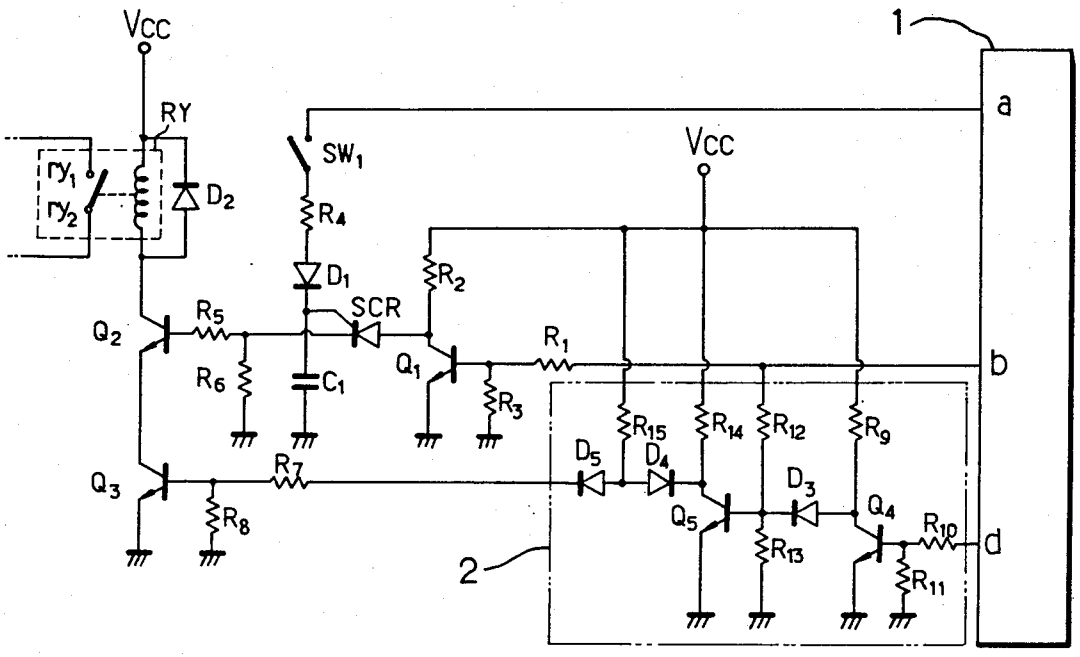
FIG. 1 is a circuit diagram of the preferred embodiment of the present invention.

In the preferred embodiment of the invention, as shown in FIG. 1, a microprocessor 1 is used as a controller of the oven's operation and two driving transistors $Q_2$ and $Q_3$ are connected in series to a power relay RY in shunt with a diode $D_2$. Terminals a and b of the microprocessor 1 are connected to one driving transistor $Q_2$ through an oven starting switch $SW_1$, a resistor $R_4$, a diode $D_1$, the gate-to-cathode path of a thyristor SCR, a resistor $R_5$ and through a resistor $R_1$, a switching transistor $Q_1$, the anode-to-cathode path of the thyristor SCR and the resistor $R_5$ respectively, while the terminal d of the same is connected to the other driving transistor $Q_3$ through a stabilizing circuit 2 and a resistor 7. The cathode of the diode $D_1$ and the gate of the thyristor SCR are grounded through a capacitor $C_1$ and the bases of the transistors $Q_1$, $Q_2$ and $Q_3$ grounded through $R_3$, $R_6$ and $R_8$ respectively.

Meanwhile, the stabilizing circuit 2 comprises a resistor $R_{10}$, two transistors $Q_4$ and $Q_5$ coupled to operate reversely, a diode $D_3$ interposed between transistors $Q_4$ and $Q_5$, two reverse-biased switching diodes $D_4$ and $D_5$. In the stabilizing circuit 2, the collectors of transistors $Q_4$,$Q_5$ and the junction of the diodes $D_4$ and $D_5$ are all coupled to power source Vcc and the collector of the transistor $Q_1$ through resistors $R_9$, $R_{14}$ and $R_{15}$ respectively, while the base of the transistor $Q_5$ and the cathode of the diode $D_3$ are coupled to the base of the switching transistor $Q_1$ and the terminal b of the microprocessor 1 through a resistor $R_{12}$. The bases of transistors $Q_4$ and $Q_5$ are grounded through resistors $R_{11}$ and $R_{13}$ respectively.

The power relay control circuit of this invention has been designed so that the relay RY may keep operating only when a LOW signal from the said terminal b and a HIGH signal from the said terminal d come out. A HIGH signal from the said terminal b and a LOW signal from the said terminal d can not operate the relay RY (see FIG. 1).

A user of the microwave oven which has the circuit of this invention may set an appropriate heating time according to the food to be cooked by using the button or knob on the control panel of the oven, before or after he puts in the food in the oven. Accordingly, the information of such heating program is stored in the RAM semiconductor chip of the microprocessor 1 and used for controlling the operation of the magnetron.

Now, the food heating operation of the microwave oven according to the present invention is described below.

If a user presses the starting switch $SW_1$ of the oven, the microprocessor 1 prepares for controlling the oven's operation as programmed by the user and then sends a starting signal through its terminal a.

When the start signal is supplied to the gate of the thyristor SCR through the oven starting switch $SW_1$, the resistor $R_4$ and the diode $D_1$, the thyristor SCR is switched to ON state from OFF state. An electric current from the power source Vcc flows to the base of the transistor $Q_2$ through the resistor $R_2$, the anode-to-cathode path of the thyristor SCR and the resistor $R_5$.

At the same time, a LOW signal from the terminal b of the microprocessor 1 is applied to the base of the switching transistor $Q_1$ and a HIGH signal from the terminal d of the same to the base of the transistor $Q_4$ in the stabilizing circuit 2, as the microprocessor 1 is provided with the soft ware and hard ware so that the terminals b and d may send out the signals LOW and HIGH respectively during the course of the oven's heating operation.

The transistor $Q_1$ maintains the OFF state owing to the LOW signal applied from the terminal b of the microprocessor 1 and power supply from the power source Vcc is applied to the base of the transistor $Q_2$ through the resistor $R_2$, the thyristor SCR and the resistor $R_5$, causing the transistor $Q_2$ to be turned on.

The power supply from the power source Vcc can not be applied to the collector of the transistor $Q_1$ because the thyristor SCR has been switched on and the switching transistor $Q_1$ is turned off as described hereinbefore, but is applied to the base of the transistor $Q_2$ instead through the thyristor SCR and the resistor $R_5$, maintaining the transistor $Q_2$ turned on.

As the transistor $Q_4$ in the stabilizing circuit 2 is turned on by the HIGH signal from the said terminal d of the microprocessor 1, the transistor $Q_5$ is turned off.

The power supply from the power source Vcc can not be applied to the OFF-state transistor $Q_5$, but is applied to the base of the transistor $Q_3$ through the resistor $R_{15}$, the diode $D_5$ and the resistor $R_7$, making the transistor $Q_3$ turned on.

Figure 2:
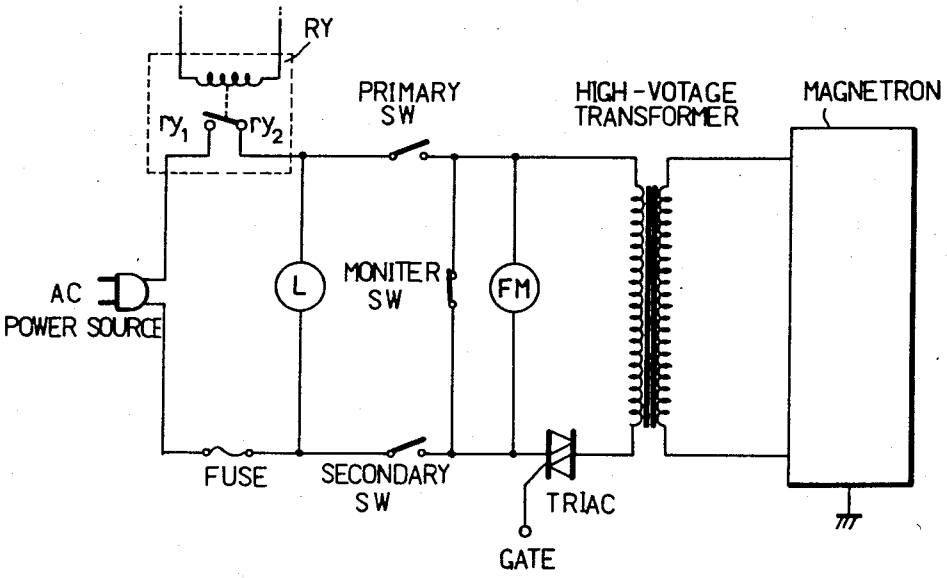
FIG. 2 shows a power supply circuit to the magnetron oscillator.

Power supply from the power source Vcc is applied to the relay RY and flows down to biased transistors $Q_2$ and $Q_3$. As the relay RY is operated, power supply is applied to the pilot lamp and the fan motor through the make-contacts $ry_1$ and $ry_2$ of the relay RY, and further to the primary winding of the high-voltage transformer, when a triac receives an operation signal through its gate terminal from the microprocessor 1 at a certain interval after the relay RY is operated as such programmed (see FIG. 2). The magnetron starts to function as a high-frequency oscillator, when the voltage of the primary winding of the high voltage transformer is applied to and a high voltage is induced in the secondary winding of the high-voltage transformer.

When the heating operation of the oven ends or the oven is not used for heating or cooking the food, a HIGH signal comes out from the terminal b of the microprocessor 1 and turns on the transistor $Q_1$, making the power source Vcc grounded through the resistor $Q_2$ and the transistor $Q_1$. The transistor $Q_2$ can not help maintaining the OFF state, as no electric current can flow through the thyristor SCR from the power source Vcc grounded through the resistor $R_2$ and ON-state transistor $Q_1$.

A LOW signal from the said terminal d turns off the transistor $Q_4$ and therefore the transistor $Q_5$ is turned on, making the power source Vcc grounded through the resistor $R_{14}$ and the transistor $Q_5$. Thus, no power supply is applied to the base of the transistor $Q_3$ and it maintains the OFF state.

As both of the transistors $Q_2$ and $Q_3$ are in the OFF state, the relay RY does not operate. No power supply can be applied to the pilot lamp, the fan motor and the high-voltage transformer in the power supply circuit of FIG. 2. Without any power supply, the magnetron can not carry out the oscillating function, of course.

As can be seen from the above description of the present invention, the relay RY, for use in applying power supply to the magnetron, can not be operated by using only the starting switch $SW_1$, but can be operated only when the microprocessor 1 sends out a LOW signal from its terminal b and a HIGH signal from its terminal d, causing both of the driving transistors $Q_2$ and $Q_3$ to be turned on.

If the microprocessor 1 operates abnormally, both of the signals from its terminals b and d will be the same level, all LOWs or all HIGHs and such signals can not turn on the driving transistors $Q_2$ and $Q_3$ altogether. When either of the transistors $Q_2$ and $Q_3$ is not turned on, the power relay RY is prevented from being operated, and the high-voltage transformer can not help the magnetron to operate.

While there has been illustrated and described what is considered at present to be preferred embodiment of the present invention, it is apparent that the present invention provides the advantages to protect the microwave oven itself and also its users because the oven is prevented from being abnormally operated or overheating food or drink.

The forgoing description shows only a preferred embodiment of the invention. It will be easily understood that various modifications are apparent to those skilled in the art without departing from the scope of the invention. The invention is to be limited only by the appended claims and the embodiment shown and described is only illustrative, but not restrictive.

What is claimed is:

1. A power relay control circuit for a microwave oven including a microprocessor as its controller, the circuit comprising:

two driving transistors connected in series to a power relay;

a switching means between one of said driving transistors and two output terminals of said microprocessor, and a stabilizing circuit between the other of said driving transistors and another output terminal of said microprocessor, said stabilizing circuit including two transistors, which are connected with a diode interposed between them and operates reversely to each other, bias resistors; and two reverse-biased switching diodes, one of said bias diodes biasing the bse of the other of said driving transistors upon receipt of a signal from said microprocessor.

2. The circuit according to claim 1 wherein said switching means includes;

a thyristor, having a cathode connected to the base of one of said driving transistors through bias resistors and a gate connected to an oven starting switch and grounded capacitor; and a switching transistor, having a base connected to said microprocessor through bias resistors and a collector connected to the anode of said thyristor, said thyristor biasing the bse of one of said driving transistors upon receipt of a signal from said microprocessor.

* * * * *